United States Patent [19]

Focke

[11] 4,213,362

[45] Jul. 22, 1980

[54] CUTTING APPARATUS FOR SEPARATING CIGARETTE WRAPPER BLANKS FROM WEB

[75] Inventor: Heinz Focke, Verden, Fed. Rep. of Germany

[73] Assignee: Focke & Pfuhl, Verden, Fed. Rep. of Germany

[21] Appl. No.: 922,697

[22] Filed: Jul. 7, 1978

Related U.S. Application Data

[63] Continuation of Ser. No. 827,634, Aug. 25, 1977, abandoned.

[30] Foreign Application Priority Data

Aug. 31, 1976 [DE] Fed. Rep. of Germany ..... 2639216

[51] Int. Cl.[2] ..... B31B 1/16; B31B 1/20; B31B 41/14

[52] U.S. Cl. ..... 83/100; 83/43; 83/622; 93/33 R; 93/58.3

[58] Field of Search ..... 83/43, 620, 622, 100; 93/33 R, 58.3

[56] References Cited

U.S. PATENT DOCUMENTS

| | | | |
|---|---|---|---|
| 1,736,049 | 11/1929 | Nordendale | 83/622 |
| 3,222,967 | 12/1965 | Godfrey | 83/100 |
| 3,373,643 | 3/1968 | Spengler | 83/620 |
| 3,599,520 | 8/1971 | Wood | 83/43 |
| 4,012,275 | 3/1977 | Sjohölm et al. | 83/100 |

*Primary Examiner*—Donald R. Schran
*Attorney, Agent, or Firm*—Sughrue, Rothwell, Mion, Zinn and Macpeak

[57] ABSTRACT

A web 26 of packaging material on which a plurality of cigarette wrapper blanks 10 are defined in oppositely rotated and laterally dsplaced pairs, is fed between a reciprocatable punch 38 and a fixed support 36 having cooperating cutting edges 39 and counter edges 40, respectively, whereby the downward movement of the punch severs a pair of blanks from the web. The continued downward movement of the punch separates the two blanks of the severed pair through the cooperation of a further cutting edge 45 on the punch and a counter edge 46 on a turntable 41 disposed beneath the fixed support. The turntable is then rotated 180° to successively feed the separated blanks to a suction conveyor 47.

6 Claims, 7 Drawing Figures

26
27
20
23
22
19
23
21
27
17
14
25
16
25
15
18
24

10
45
46
38
36
41
44
43
42

CUTTING APPARATUS FOR SEPARATING CIGARETTE WRAPPER BLANKS FROM WEB

This is a continuation of application Ser. No. 827,634, filed Aug. 25, 1977, now abandoned.

BACKGROUND OF THE INVENTION

The invention relates to a wrapper for cigarettes, especially a soft wrapper with a covering which encloses the contents of the pack in the area of its bottom, its narrow side walls and its front and rear walls. Furthermore, the invention concerns the arrangement of blanks for the production of such wrappers on a web of wrapping material. Finally, the method and apparatus for the separation of the blanks from the web are also objects of the invention.

Of concern here is a type of wrapper for cigarettes etc., which in principle has been known as soft pack. Such soft packs are formed such that the contents of the package, namely a block of cigarettes wrapped in a tin foil blank, is received in an open sheating, a so-called soft cup. A cellophane blank has been provided as an outside wrapper of this pack. The invention deals with the development and production of the sheating (soft cup) surrounding the tin foil wrapper.

Two different embodiments are known for the development of the wrapper known as a soft cup. In the one, the blank is first folded in the form of a tube, possibly with simultaneous wrapping of the contents of the pack. At the same time marginal flaps of the front and the rear wall are completely overlapped and interconnected in the area of the lateral walls. The bottom is formed by initially projecting flaps, and in such a way that lateral terminal flaps which initially project longitudinally in the area of the lateral walls and the bottom flaps are folded. As a result, a so-called envelop fold is formed.

The other embodiment of this wrapper is such that a blank, in which the front and rear walls are interconnected by the bottom, is folded in a U-shape from the bottom around the contents of the package. Lateral flaps overlap each other in the area of both lateral walls.

SUMMARY OF THE INVENTION

The basic objective of the invention is to further develop and improve packs of the above mentioned type, so that, while maintaining the same basic construction, there will be a lower requirement for packaging material.

In order to achieve this objective, the wrapper of the invention is characterized by overlapping flaps in the area of the bottom or of the lateral walls being formed with variable widths in such a way that blanks for forming the wrappers may be separated from a web or similar strip of wrapping material without waste.

The basic idea of the invention thus consists in developing the blanks for making the packs or soft cups in such a manner, that the blanks may be separated without waste and at lower material requirements without essential changes of the geometry of folding in the area of the bottom and of the lateral walls. The variable width flaps have, at the same time, been always disposed such that the narrow flaps are folded first, and the broad flaps are folded last so as to lie on the outside of the finished pack. As a result the impression of a conventional fold is maintained in the outward appearance, despite lower material expenditure.

Depending on the development of the blanks, the latter are disposed in pairs, side by side along the web, or individually in succession. Where two blanks are arranged side by side, two blanks are always separated from the web in one action and subsequently from each other in another separating process. The separation of the blanks from the web and from one another takes place during the downward movement of the web from an incoming plane to an exiting one. For this purpose, the apparatus of the invention is equipped with a cutting plate which has two cutting edges which are displaced relative to each other. These in turn cooperate with locally fixed cutting edges.

Further characteristics of the invention concern the structure of the packs or of the blanks, the arrangement of the blanks on a web of wrapping material, a process for separation thereof and details of the apparatus.

DETAILED DESCRIPTION OF THE PREFERRED EMBODIMENTS

Figure 1:
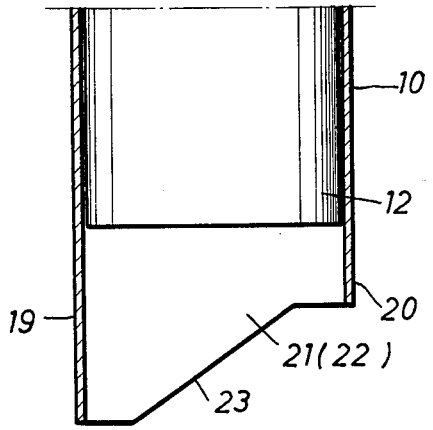
FIG. 1 shows a vertical cross-sectional view of the lower part of an embodiment of the wrapping of the invention in an intermediate folded condition.

The wrappers for cigarettes discussed here are known as soft wrappers or soft packs. A blank 10 or 11 forming a part of the pack is made of paper and envelops, as a "soft cup", a block of cigarettes 12 within a tin foil. The wrapper formed by this blank 10 or 11 is predominantly developed such that the upper front surface of the pack remains free. The wrapper thus extends over or covers a bottom 13, mutually opposite narrow side walls 14 and 15, and mutually opposite front and rear walls 16 and 17. The blanks 10 or 11 for forming the wrappers may be, according to the examples shown here, of two different types. In case of the construction of FIGS. 1 to 3, first a tube of rectangular cross section is formed from the blank 10, whereby a lateral flap 18 adjoining the side wall 15 is connected to the inside of the adjoining edge of the rear wall 17. The tube thus formed has bottom flaps which project beyond the contents of the pack. These bottom flaps include a relatively wide bottom flap 19, almost corresponding to the width of the bottom 13, and an opposite bottom flap 20 relatively which is narrow. The bottom flaps 19 and 20 always adjoin a front wall 16 and a rear wall 17. Lateral terminal flaps 21 and 22 are formed between the bottom flaps 19 and 20 as extensions of the side walls 14 and 15, which always form the transition between the wide bottom flaps 19 to the narrow bottom flaps 20 with a sloping edge 23. The arrangement is such that the area of the lateral terminal flaps 21 and 22 facing the adjoining bottom flaps 19 and 20 always starts at the width of the pertinent bottom flap and the bevelled edge 23 follows immediately.

The flaps, projecting in the area of the bottom 13 as shown in FIG. 1 are folded such that the lateral terminal flaps 21 and 22 are folded in from the sides toward the contents of the pack. Then the narrow bottom flap 20 and finally the wide bottom flap 19 are folded in. This results in the configuration shown in FIG. 2. The dimensions are such that the free edge of the narrow bottom flap 20 is completely covered by the folded wide bottom flap 19. As a result, the outward appearance is one of a slightly unsymmetrical envelope fold. In order to make the folding easier, folding lines 24 directed slantingly or at an angle to one another are preimpressed in the area of the projecting flaps 19 . . . 22. The walls 14 . . . 17 are also delimited by folding lines 25.

The blanks 10, are always disposed side by side, transversely to the longitudinal direction of a web 26 of the wrapping material. The projections of the blanks 10 formed by the wide bottom flaps 19 and by the adjoining areas of the lateral terminal flaps 21 and 22 enter into recesses which are formed by the narrow bottom flaps 20 and adjoining areas of the lateral terminal flaps 21 and 22 of two successive blanks 10. In the area of the flaps 19 . . . 22, facing each other in the middle of the web, there develops an approximately meander-shaped continuous line 27 separating two rows of blanks side by side. These blanks may be separated from the web 26 free of waste.

Figure 4:
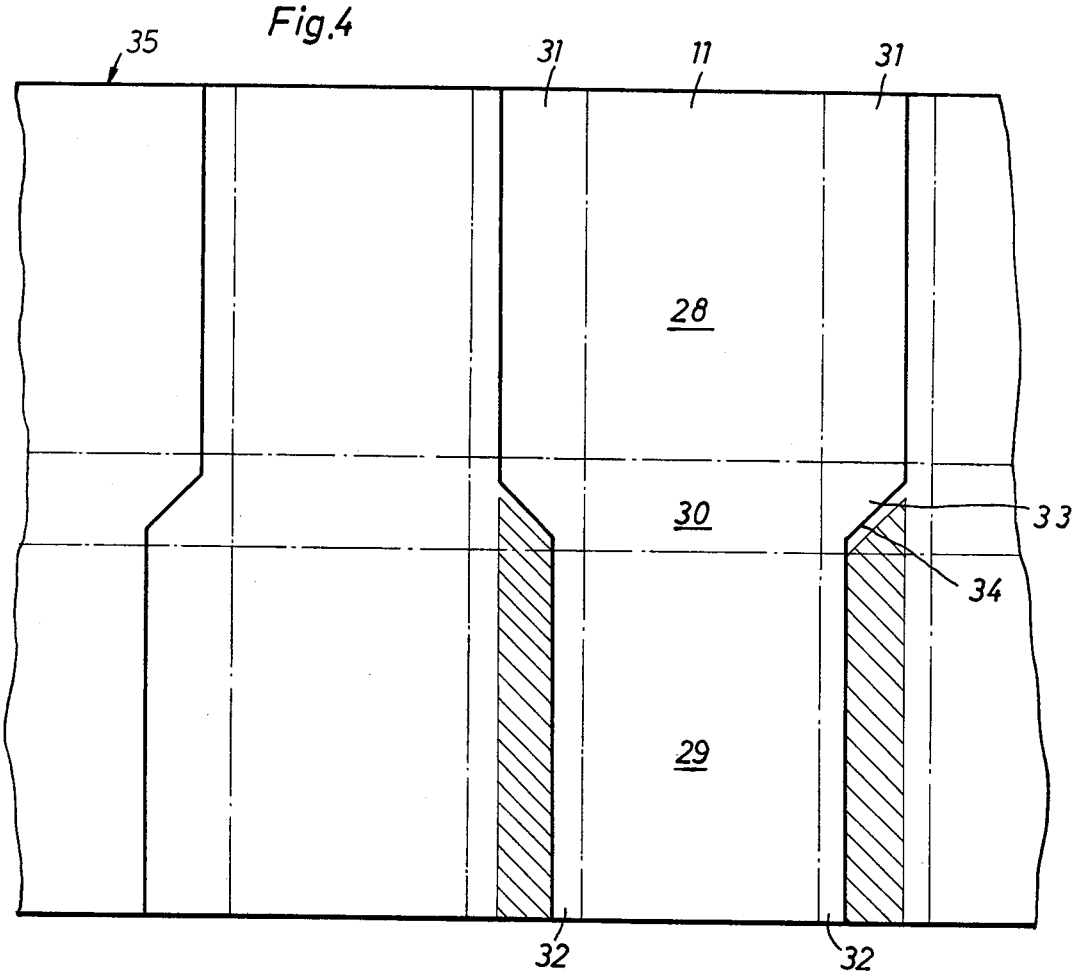
FIG. 4 is a view similar to FIG. 3 of a wrapping web with pre-marked blanks of another embodiment.
Figure 5:
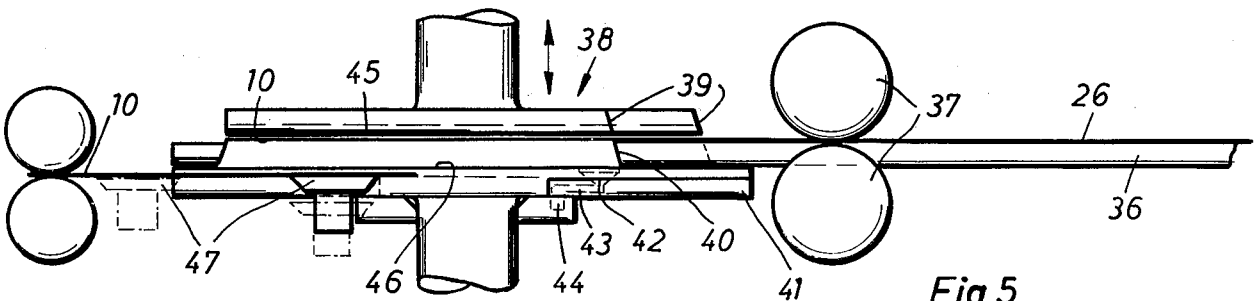
FIG. 5 is a side view of an apparatus for separating blanks from a web of wrapping and conveying it in a partially cut form.

The same advantages are achieved with the blanks 11 shown in FIG. 4. In this case the front wall 28 and the rear wall 29 are interconnected via a bottom 30. Wide lateral flaps 31 adjoin the front wall 28 and narrow lateral flaps 32 adjoin the rear wall 29. The wide lateral flaps 31 have transverse dimensions which correspond approximately to the width of the side walls of the pack. Corner flaps 33 are formed in the area of the bottom 30, and have a slope 34 forming the transition between the lateral flaps 31 and 32 in the manner already explained.

The wrapping from the blank 11 is formed such that the blank is folded in a U-shape around the contents of the pack while the bottom 30 fits against said contents. Then the lateral flaps 31 and 32 are folded back in such a way that the narrow lateral flap 32 rests on the inside and the wide lateral flap 31 on the outside.

These blanks 11 are also separated from a web 35 free of waste. The blanks 11 extend over the entire width of the web 35. The blanks 11 are always shifted by 180° in the longitudinal direction of said web, so that wide lateral flaps 31 and narrow lateral flaps 32 interleave with each other.

Figure 2:
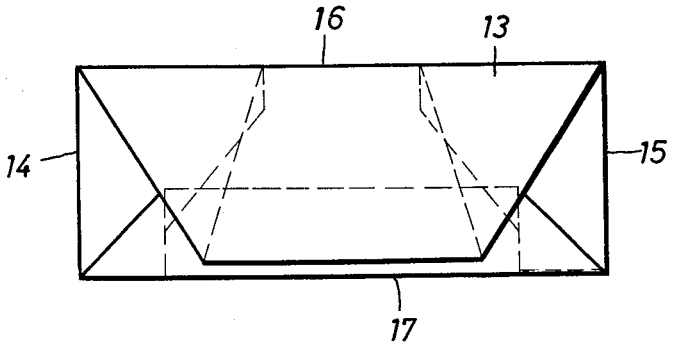
FIG. 2 shows a bottom view of the pack of FIG. 1 in a finished folded state.
Figure 3:
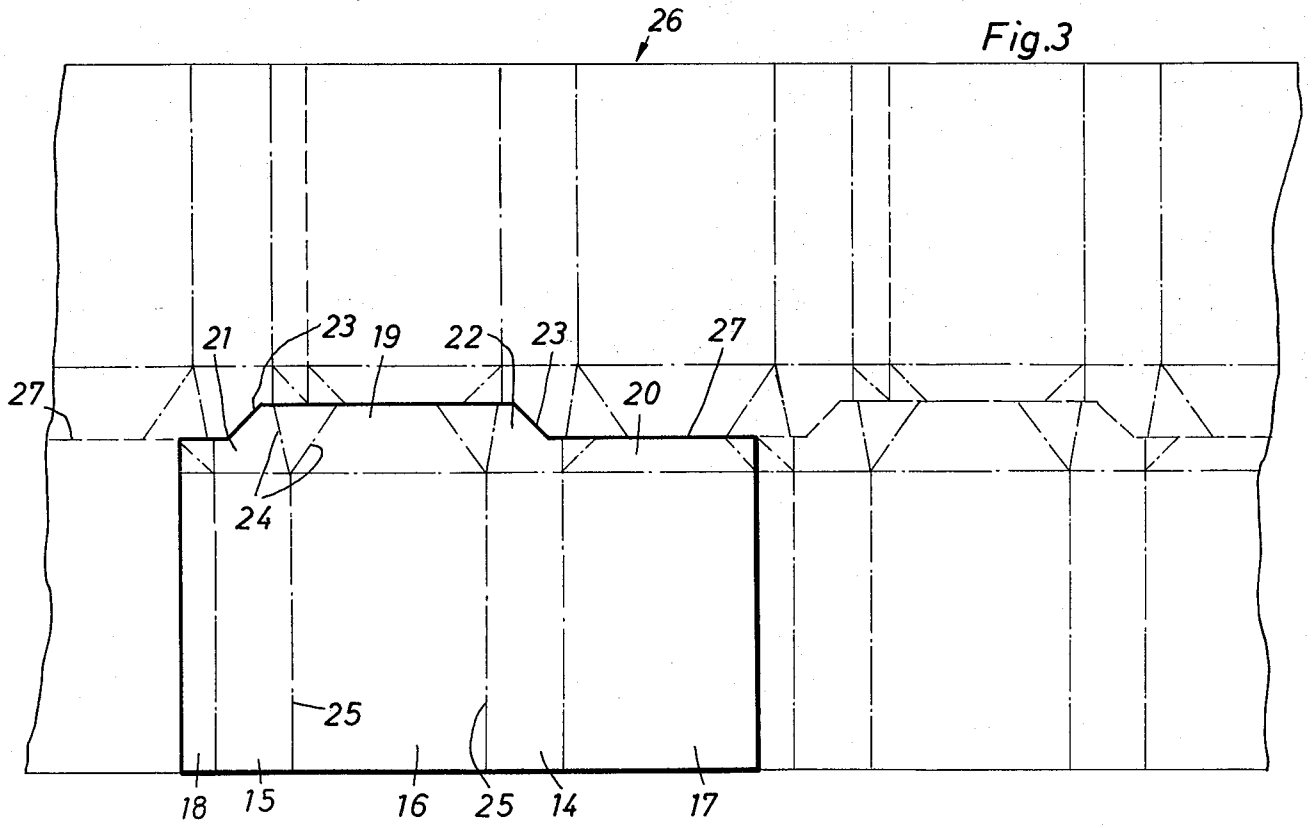
FIG. 3 is a section of a web of wrapping material with pre-marked blanks for packs as in FIGS. 1 and 2.

In the embodiment of the blanks 10 as in FIGS. 1 to 3, two blanks 10 lying side by side transversely to the web 26, are always separated simultaneously in one separating action. The blanks 10, which at first are connected along a separating line 27, are then separated from one another in the area of said separating line 27 and fed to a packaging station.

Figure 6:
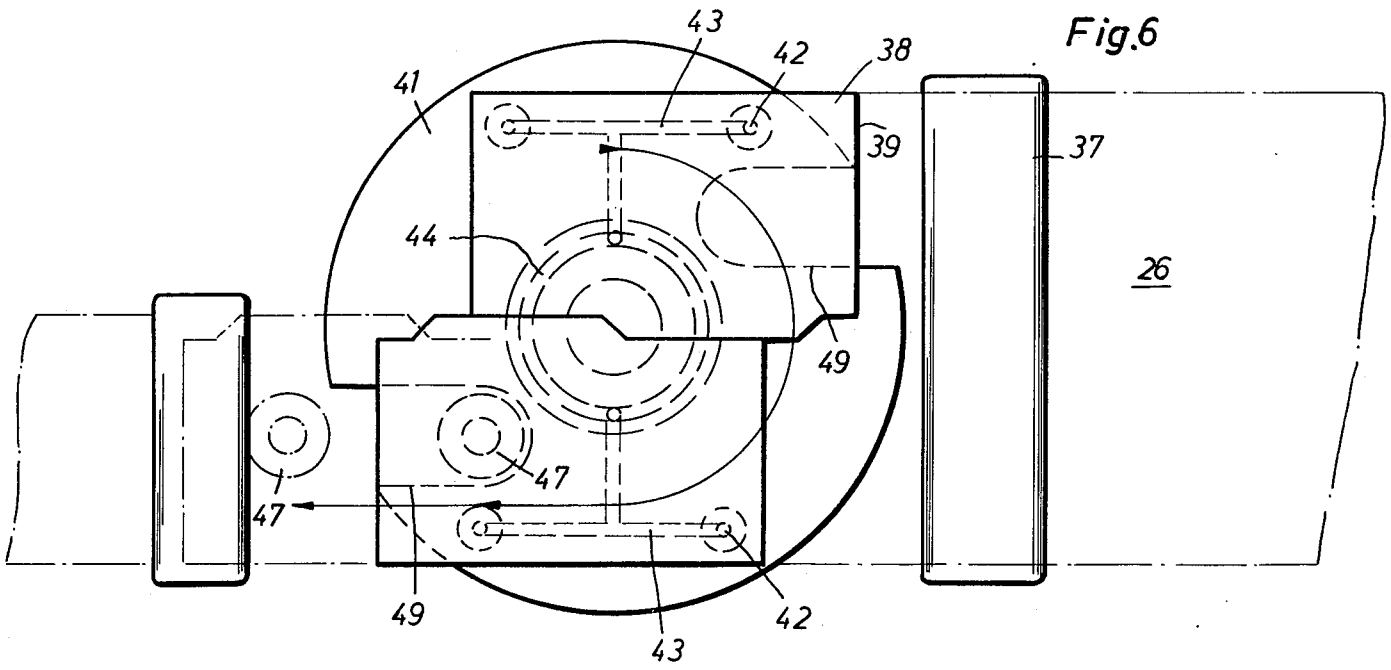
FIG. 6 is a top view of FIG. 5.
Figure 7:
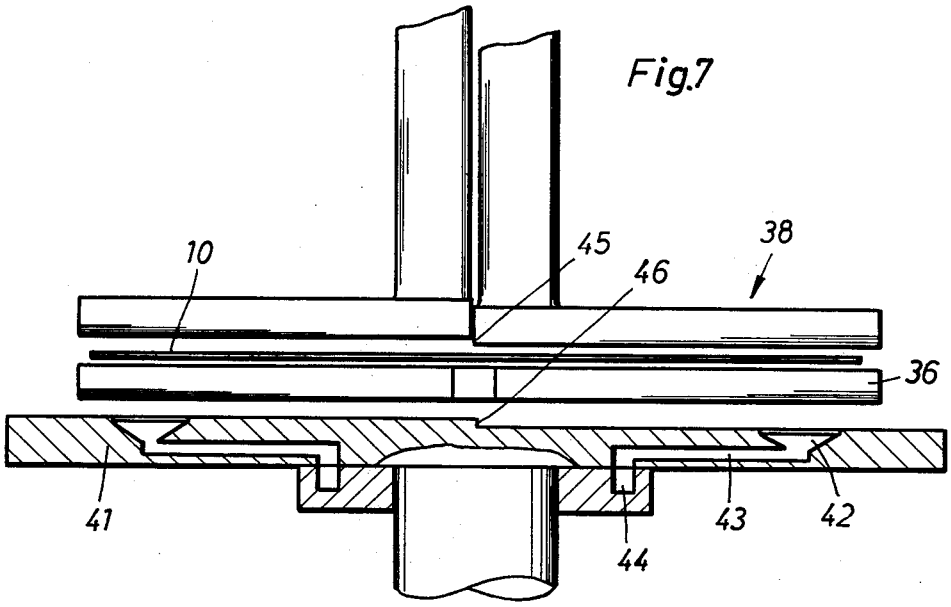
FIG. 7 is a front view of the apparatus as in FIG. 5, shifted by 180°.

In the apparatus shown as an embodiment by way of example, the web 26 is fed-in on a locally fixed support 36, for example by way of feed rolls 37. Here, two blanks 10 are separated from the web 26 by a punch 38. At the same time the two blanks 10 of the web 26 are conveyed underneath the plateshaped puch 38. The edge of said punch 38 facing the support 36 is formed as a cutting edge 39. The latter cooperates with a fixed counter edge 40 which is formed by the edge of the support 36. The cutting edge 39 and counter edge 40 follow the shape of the shifted blanks 10 lying side by side (FIG. 6). As may be seen, the punch 38 has the cross-sectional shape of the two blanks 10, which at first are still connected. The two blanks 10 are separated from the web 26 in the area of the counter edge 40, by a downward movement of the punch 38.

A further downward movement of the punch 38 conveys said two blanks 10 to a support, namely a turntable 41. This turntable 41 serves for the intermittent reception of the blanks 10. For holding the blanks 10 said turntable 41 has been provided with suction holes 42, which are connected in a basically known manner via suction channels 43 with a ring-shaped control channel 44. The latter is connected to a vacuum source.

The separation takes place in the area of the separating line 27 on the way to said turntable 41. Here again the punch 38 acts as a movable cutting element with respect to a locally fixed counter edge 46. The cutting edge 45 of the punch 38 is formed by a similarly shaped section on the underside of the punch. The contour corresponds to that of the separating line 27. Correspondingly, the counter edge 46 is formed as a shoulder on the turntable 41. The previously mentioned edges are moved past each other, as a result of which a separating cut occurs.

The two blanks 10 are conveyed on by the turntable 41. At the same time the blanks 10 are successively removed from the turntable 41. In case of the present embodiment a suction conveyor 47 has been provided for this purpose. The latter seizes the underside of each blank 10 and conveys it to a pair of feed rolls 48. The suction conveyor 47 enters into a recess 49 of the turntable 41 in order to grip the blank 10. Two of these recesses 49 are always disposed in the area of a blank 10. The suction conveyor 47 is driven reciprocatingly or revolvingly, and in such a way that two conveying strokes of the suction conveyor 47 are performed after every separating stroke of the punch 38.

I claim:

1. Apparatus for successively separating blanks for wrappers, particularly cigarette packs, from a continuous web of packaging material including a plurality of blank pairs arranged laterally to the direction of conveyance of said web, the blanks in each pair being rotated 180° opposite each other and laterally displaced relative to each other, said apparatus comprising:

(a) a punch having first and second cutting edges, (b) a first counter edge fixed beneath said punch, aligned and cooperating with said first cutting edge of said punch, (c) means moving said punch downward relative to said first counter edge to separate a pair of blanks from the web, (d) a turntable arranged beneath said punch, (e) a second counter edge on the turntable oriented in the direction of conveyance of said web and cooperating with said second cutting edge on said punch wherein additional downward movement of said punch separates the respective blanks in each blank pair, and (f) means for rotating said turntable and said blanks 180°.

2. Apparatus according to claim 1, further comprising removing means to which the blanks separated from one another may be fed by said turntable, one blank of each removed blank pair being rotated through 180° thereby.

3. Apparatus according to claim 2, wherein said removing means for the individual blanks is formed as a suction conveyor, which can take hold of the underside of said blanks and pull them off said turntable.

4. Apparatus according to claim 3, wherein said suction conveyor is capable of entering into an open recess of the turntable associated with each blank.

5. Apparatus according to claim 1, further comprising a stationary support for said web, said stationary support having a free edge defining said first counter edge, and wherein said first cutting edge of said punch and said first counter edge correspond to the shape of the blank pairs to be separated.

6. Apparatus according to claim 1 or 5, wherein said punch is formed as a plate, said first cutting edge is formed at the edge of said punch, and said second cutting edge is formed by a shoulder in a central area of said punch.

* * * * *